US007331809B2

(12) United States Patent
Lee et al.

(10) Patent No.: US 7,331,809 B2
(45) Date of Patent: Feb. 19, 2008

(54) COMPUTER SYSTEM WITH FIXING MODULE FOR RISER CARD THEREOF

(75) Inventors: Chun-Hung Lee, Taipei (TW); Shih-Tsung Chen, Taipei (TW)

(73) Assignee: Tyan Computer Corporation, Taipei (TW)

( * ) Notice: Subject to any disclaimer, the term of this patent is extended or adjusted under 35 U.S.C. 154(b) by 0 days.

(21) Appl. No.: 11/384,283

(22) Filed: Mar. 21, 2006

(65) Prior Publication Data

US 2007/0224870 A1 Sep. 27, 2007

(51) Int. Cl.
*H01R 13/73* (2006.01)

(52) U.S. Cl. ..... 439/327; 439/377

(58) Field of Classification Search ..... 439/327, 439/377, 573; 361/801, 802
See application file for complete search history.

(56) References Cited

U.S. PATENT DOCUMENTS

| | | | | |
|---|---|---|---|---|
| 3,829,741 | A * | 8/1974 | Athey | 361/756 |
| 6,030,251 | A * | 2/2000 | Stark et al. | 439/377 |
| 6,183,285 | B1 * | 2/2001 | Szu | 439/327 |
| 6,310,779 | B1 * | 10/2001 | Wang | 361/760 |
| 6,331,940 | B1 * | 12/2001 | Lin | 361/785 |
| 6,629,855 | B1 * | 10/2003 | North et al. | 439/325 |

* cited by examiner

*Primary Examiner*—Tho D. Ta
(74) *Attorney, Agent, or Firm*—Birch, Stewart, Kolasch & Birch, LLP

(57) ABSTRACT

A computer system with a fixing module for riser card thereof is provided. By allowing the bottom side of the supporting pillar and the bottom parts of the two opposite sides of the supporting pillar engaging with each other, the riser card is supported by stress from all directions around it. Therefore, enough supporting strength is efficiently provided within a limited space and the riser card is prevented from being bended and having deformation because of the heavy weight.

20 Claims, 9 Drawing Sheets

COMPUTER SYSTEM WITH FIXING MODULE FOR RISER CARD THEREOF

BACKGROUND OF THE INVENTION

1. Field of Invention

The present invention relates to a computer system applied for processing electronic data, and more particularly, to a computer system with a fixing module providing enough supporting strength to the riser card thereof.

2. Related Art

In computer system, the most primary constituent is the motherboard which carries multiple electric components thereon. Among these electric components, a processing unit is the most important one, i.e. a central processing unit (CPU) manages the main processing and calculating work of all kinds of data, which is the so-called "heart" of a computer system. Despite a CPU is the main managing component, it still can not function normally without coordinating with other periphery electric components.

Basically, a computer system is primarily constituted of four parts, CPU, memory, hard disc, and graphic card. A CPU dominates the calculation, and the programs waited to be executed are "temporarily" stored in a memory which is considered the first storage unit when its playing role is the compared with a hard disc's. Only when the data waited to be processed by CPU has not been loaded in a memory, the system will enter and search in a hard disc. Therefore, the hard disc plays the role of "auxiliary memory." However, after the computer is shutdown, the content stored in system memory will disappear along with electricity cutoff. In other words, the content in a memory is under a temporary-stored status, unlike a hard disc, the data inside is stored permanently.

While a memory has a higher and higher capacity, besides the original role of systematizing and storing software, it has been started to be utilized by other hardware components in order to achieve the purpose of lowering cost and raising efficiency, i.e. the interface structure of AGP or PCI Express is designed to store image material by using the system memory through Graphic Processing Unit (GPU) so as to accelerate the processing speed and performance of video data.

Generally speaking, the number of memory slots is limited in a computer system. For a common personal computer, 3 memory slots are the maximum and the extendable capacity is thus limited. The extendable performance is clearly not enough for some systems like working stations or super computers. Later, the so-called riser card is developed. Please refer to FIG. 1. The riser card 11 is inserted into the slot of common PCI interface and has multiple slots 12. Usually the riser card 11 has 8 slots for extended memories. However, unlike a common PCI interface, when all the slots 12 are inserted with memories, the riser card 11 will be bended and the shape thereof will be deformed due to the memory has a certain height and weight, and the supporting strength provided from the insertion of the riser card 11 into the PCI interface slot is not enough. A design of additional fixing module is then needed. However, the space between the slots of PCI interface is too small to allow a changeable design. Therefore, how to improve the fixing module for riser card has become a critical issue for those skilled in the art.

SUMMARY OF THE INVENTION

To solve the above-mentioned problem, the present invention provides a computer system with a fixing module for riser card thereof, which provides enough supporting strength for the riser card in a limited space so as to prevent from the instability of the computer system once the riser card is bended and has deformation, caused by mounting memories on the riser card and the weight generated thereby.

In accordance with the fixing module for riser card disclosed in the present invention, the fixing module includes two supporting pillars, a fixing fragment, and two fixing components. The two supporting pillars are respectively disposed at two sides of the riser card. Each supporting pillar includes at least one fixing opening secured with the riser card, two opposite sides, and a bottom side. The bottom side of the supporting pillar and the bottom parts of the two opposite sides are engaged with each other. Meanwhile, the bottom side has a securing hole. The fixing fragment is disposed at the bottom side of the motherboard and has securing openings respectively disposed at two sides of the fixing fragment, which are disposed corresponding to the securing holes on the bottom sides of the two supporting pillars. The two fixing components respectively pass through the securing openings, the motherboard, and the securing holes on the bottom sides of the two supporting pillars so as to fix the two supporting pillars and the riser card onto the motherboard.

In accordance with the computer system disclosed in the present invention, the system comprises a motherboard, two riser cards, four supporting pillars, two fixing fragments, and four fixing components. The motherboard includes at least two slots for interface card and each slot has two through holes respectively disposed at two sides of the slot. The riser card is inserted into the slots and mounted thereon. The four supporting pillars are respectively disposed at two sides of the two riser cards. Each supporting pillar includes at least one fixing opening secured with the riser card, two opposite sides, and a bottom side. The bottom side of the supporting pillar and the bottom parts of the two opposite sides are engaged with each other. Meanwhile, the bottom side has a securing hole. The two fixing fragments are disposed at the bottom side of the motherboard and has securing openings respectively disposed at two sides of the fixing fragment, which are disposed corresponding to the securing holes on the bottom sides of the two supporting pillars. In addition, each fixing fragment is mounted at the same sides of the two riser cards and connected to the two riser cards. The four fixing components respectively pass through the securing openings, the through holes of the motherboard, and the securing holes on the bottom sides of the two supporting pillars so as to fix the four supporting pillars and the riser card onto the motherboard.

In accordance with another fixing module for riser card disclosed in the present invention, the fixing module comprises a fixing pillar, a fixing fragment, and two fixing components. The fixing pillar has a U-shape and two supporting pillars respectively formed at two ends of the fixing pillar. The supporting pillar is correspondingly disposed at two sides of the riser card. Each supporting pillar includes at least one fixing opening secured with the riser card, two opposite sides, and a bottom side. The bottom side of the supporting pillar and the bottom parts of the two opposite sides are engaged with each other. Meanwhile, the bottom side has a securing hole. The fixing fragment is disposed at the bottom side of the motherboard and has securing openings respectively disposed at two sides of the fixing fragment, which are disposed corresponding to the securing holes on the bottom sides of the two supporting pillars. The two fixing components respectively pass through the securing openings, the motherboard, and the securing holes on the bottom sides of the two supporting pillars so as to fix the two supporting pillars and the riser card onto the motherboard.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
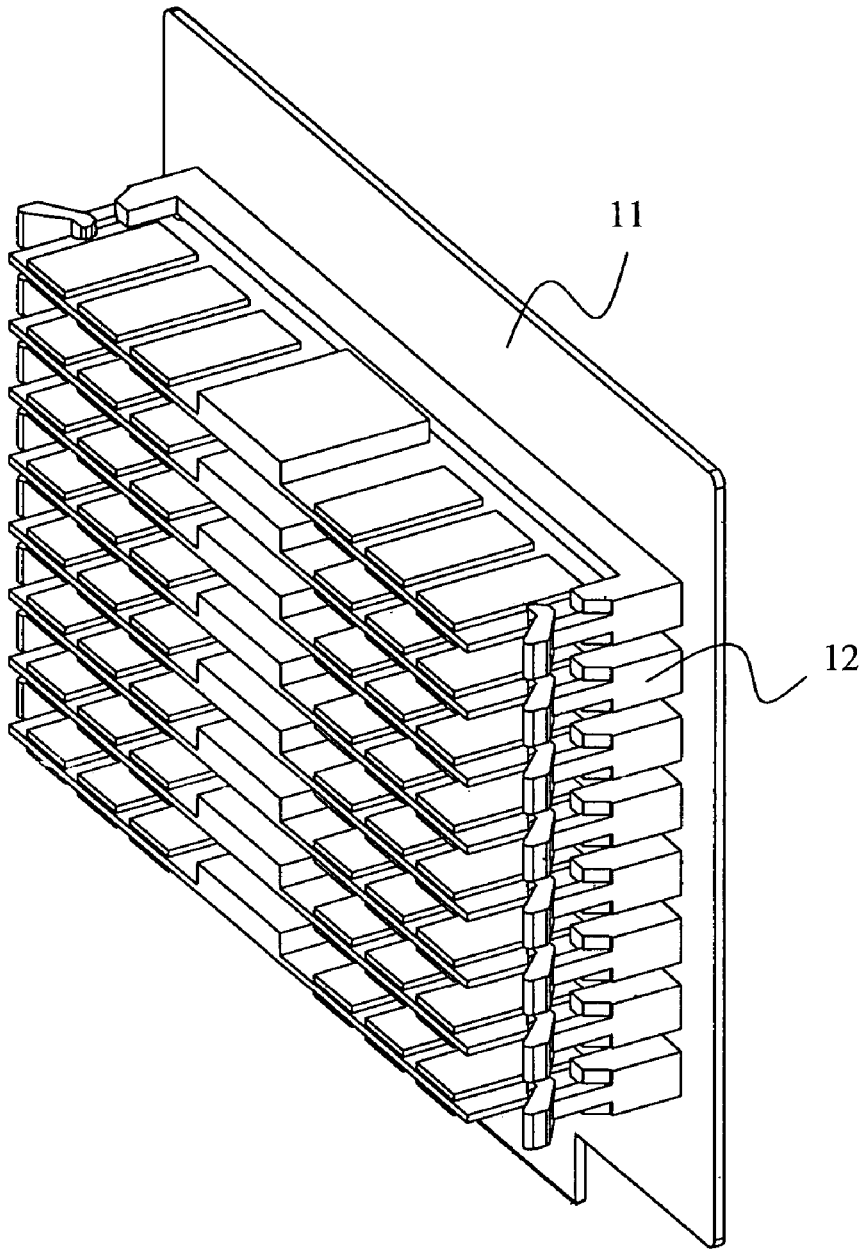
FIG. 1 (PRIOR ART)
FIG. 1 is a schematic view showing a riser card according to the prior art.
Figure 2A:
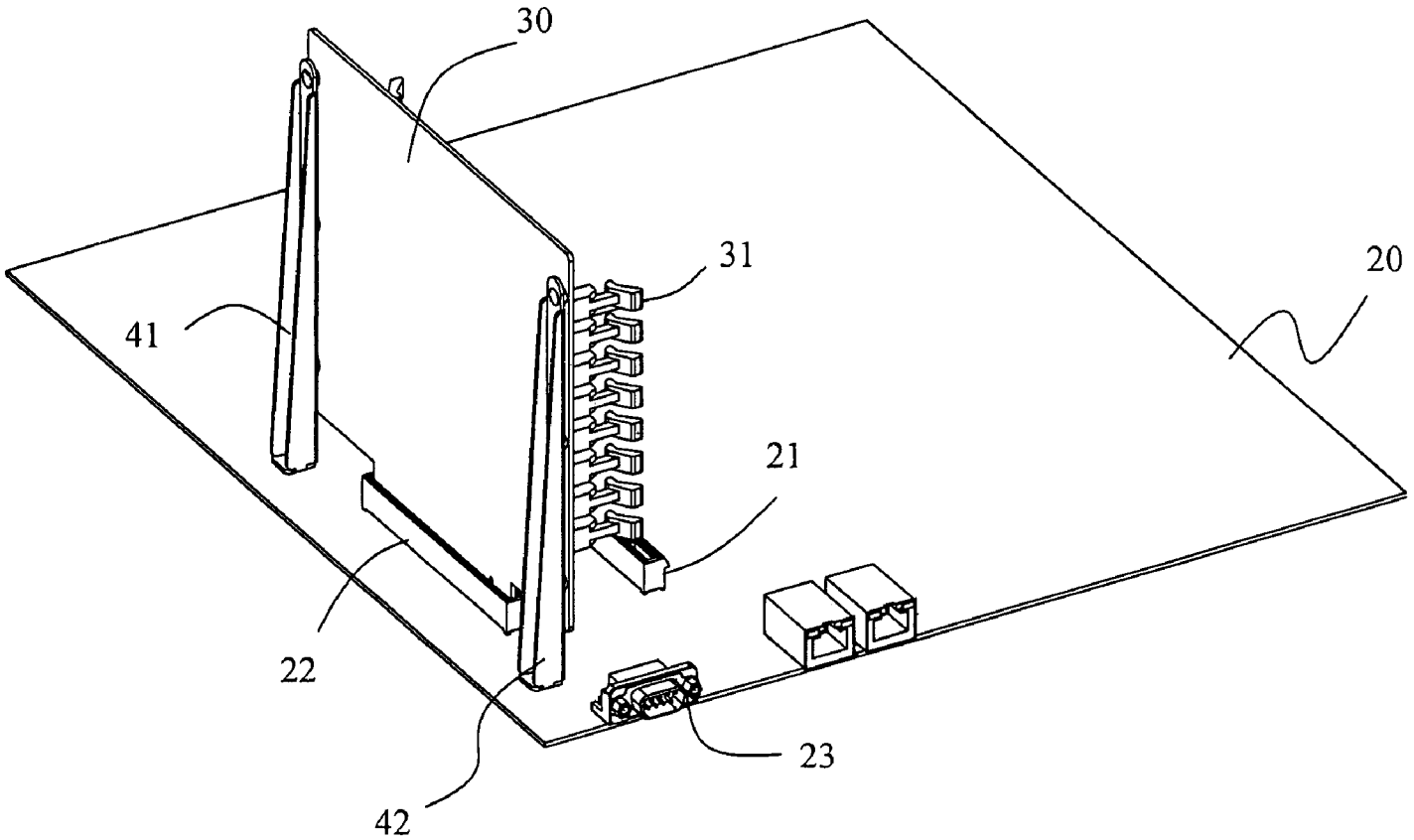
FIG. 2A is a schematic view showing the riser card fixed onto the motherboard by the fixing module according to the present invention.
Figure 2B:
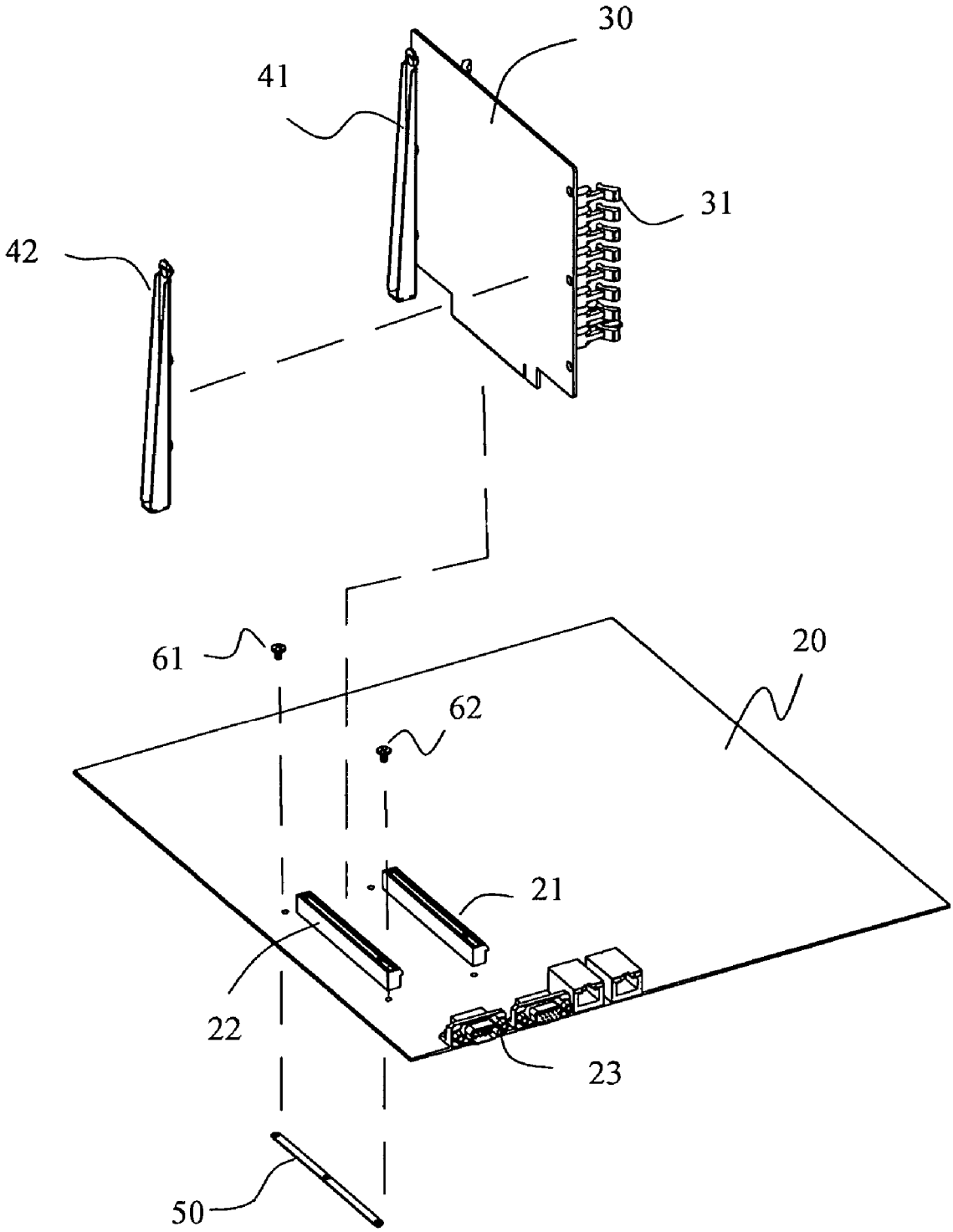
FIG. 2B is an exploded view showing the riser card fixed onto the motherboard by the fixing module according to the present invention.

In accordance with the computer system with fixing module for riser card thereof disclosed in the present invention, please refer to FIGS. 2A and 2B. The computer system includes the motherboard 20, riser card 30, and the fixing module. The motherboard 20 has two slots 21, 22 for interface card and other relevant connectors 23. Generally, the slots 21, 22 are for PCI interface cards. The riser card 30 has multiple memory slots 31 for mounting memories thereon.

The fixing module includes two supporting pillars 41, 42, the fixing fragment 50, and two fixing components 61, 62. The two supporting pillars 41, 42 are respectively disposed at two sides of the riser card 30 and both inserted into the slot 22. The two supporting pillars 41, 42 mounted at the corresponding position on the bottom side of the motherboard 20 through the fixing fragment 50 and are further fixed by the fixing components 61, 62.

Figure 3A:
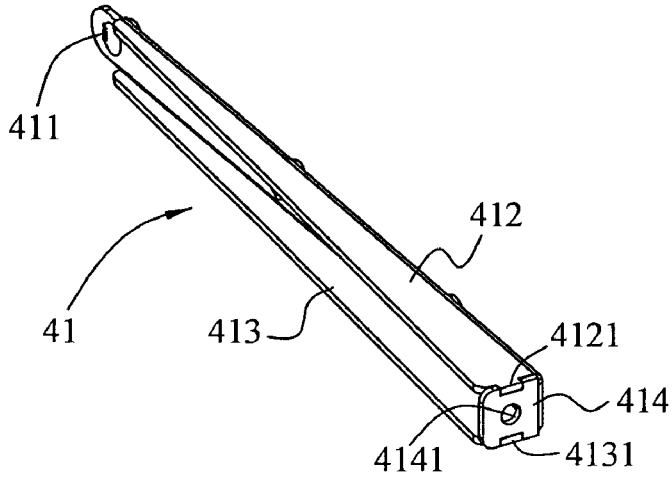
FIGS. 3A-3C are schematic views showing the supporting pillars according to varied preferred embodiments of the present invention.
Figure 3B:
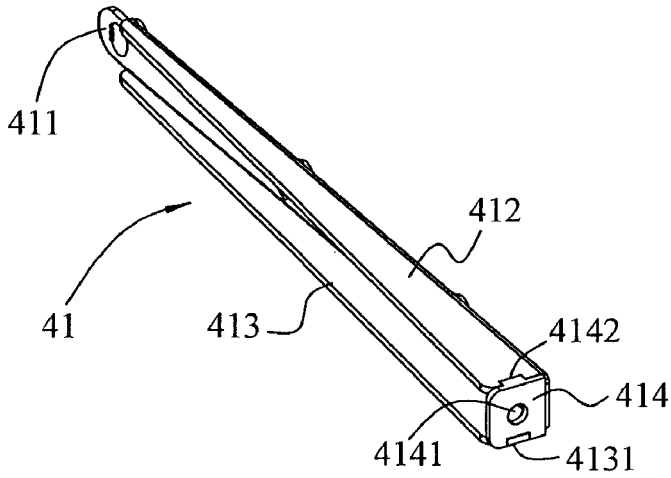
Figure 3C:
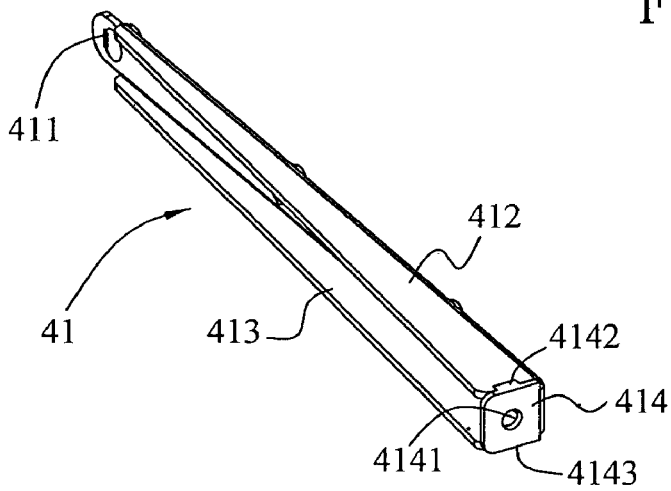

The supporting pillar 41 is taken as an example for further detailed explanation. Please refer to FIG. 3A. The supporting pillar 41 at least one fixing opening 411 for fixing elements like screws passing through and securing the supporting pillar 41 with the riser card 30 at two sides thereof. The two opposite sides, as shown in the drawing, are the first side 412 and the second side 413. The bottom side 414 of the supporting pillar 41 and the bottom parts of the two opposite sides 412, 413 are engaged with each other. Meanwhile, the bottom side 414 has a securing hole 4141 for the fixing component 61 passing through so as to fix the supporting pillar 41 onto the motherboard 20. The first side 412 and the second side 413 have widths gradually wider towards the bottom parts thereof. The bottom side of the supporting pillar 41 and the bottom parts of the first side 412 and the second side 413 are engaged with each other scraggly, as shown in the drawing. The bottom part of first side 412 has a protruding shape 4121 protruded downwards, while the second side 413 has a protruding shape 4131 protruded downwards. The bottom side 414 has two indenting sides respectively corresponding to the first side 412 and the second side 413 and having matching sizes so as to be engaged with the protruding shapes 4121, 4131 tightly. Therefore, when the riser card 30 is possibly bended and deformed because of having memories mounted thereon, it can be fixed by these scraggy and engaged-with-each-other structures in order to prevent from the deformation of the riser card 30. A similar variation can be made, please refer to FIGS. 3B and 3C. The bottom side 414 could have a protruding shape 4142 at one side (FIG. 3B), or two protruding shapes 4142, 4143 at two sides (FIG. 3C). And the first side 412 or/and the second side 413 have indenting sides corresponding to the protruding shapes 4142, 4143.

Figure 4:
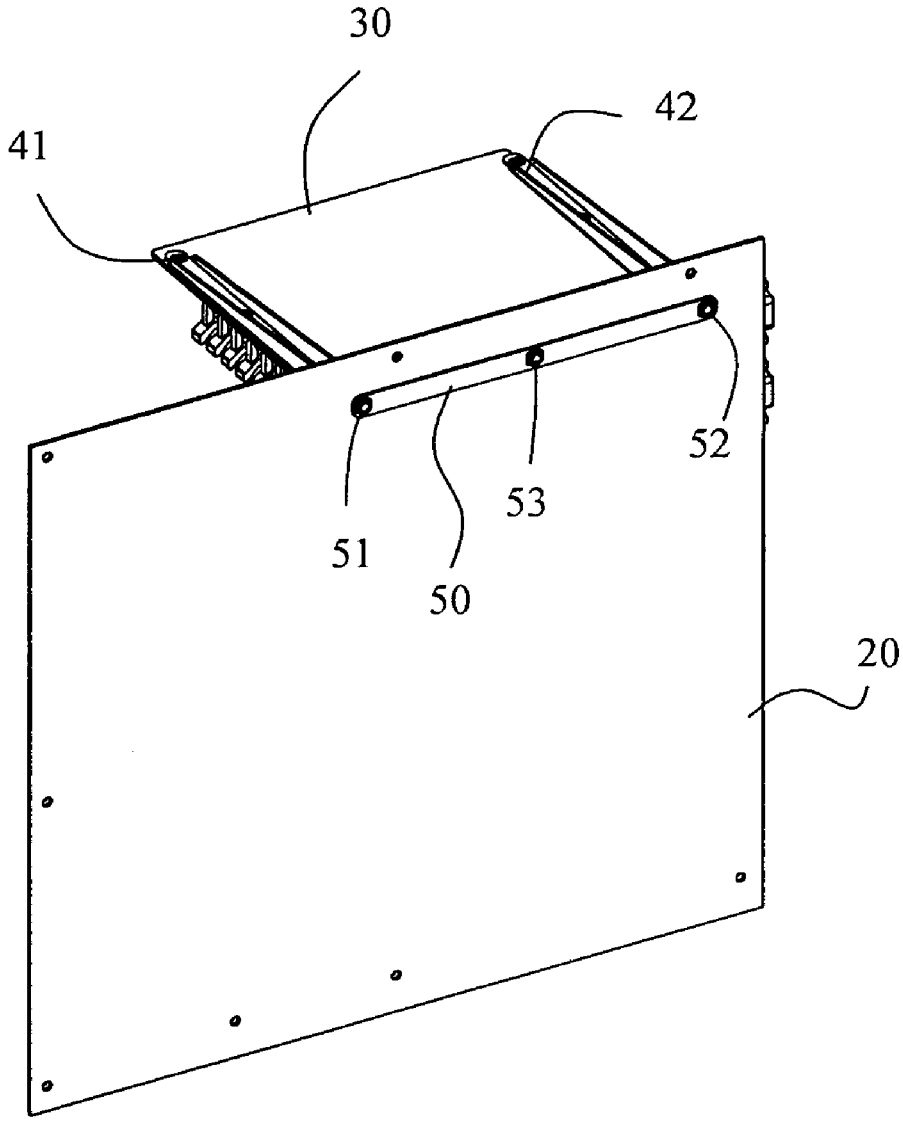
FIG. 4 is a schematic view showing the fixing fragment fixed on the motherboard according to the present invention.

As shown in FIG. 4, the fixing fragment 50 had a shape of long strip, and is disposed at the bottom side of the motherboard and corresponding to the two supporting pillars 41, 42. In addition, the fixing fragment 50 has two securing openings 51, 52 respectively disposed at two sides so that the two fixing components 61, 62 respectively pass through the securing hole 4141 on the bottom side 414 of the two supporting pillars 41, 42, the motherboard 20, and the securing openings 51, 52 at two sides of the fixing fragment 50 and the two supporting pillars 41, 42 are thus fixed. The fixing components 61, 62 are fixing elements like screws or rivets. Additionally, in order to increase the fixing strength, the fixing fragment 50 further has an auxiliary opening 53 mounted at the middle of the fixing fragment 50 for further fixing and combining the fixing fragment 50 onto the motherboard 20.

Figure 6A:
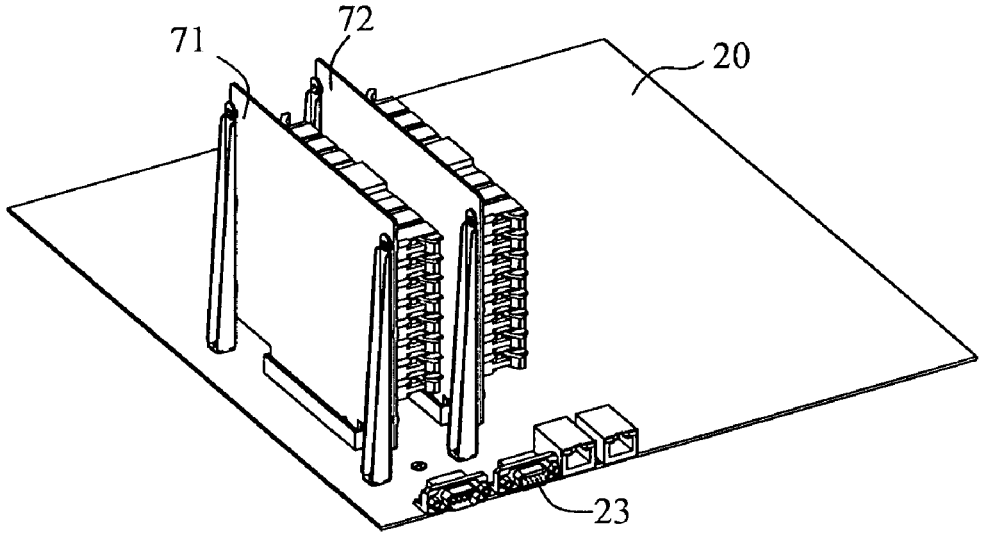
FIGS. 6A-6B are schematic views showing two riser cards fixed onto the motherboard by the fixing module according to a preferred embodiment of the present invention.
Figure 6B:
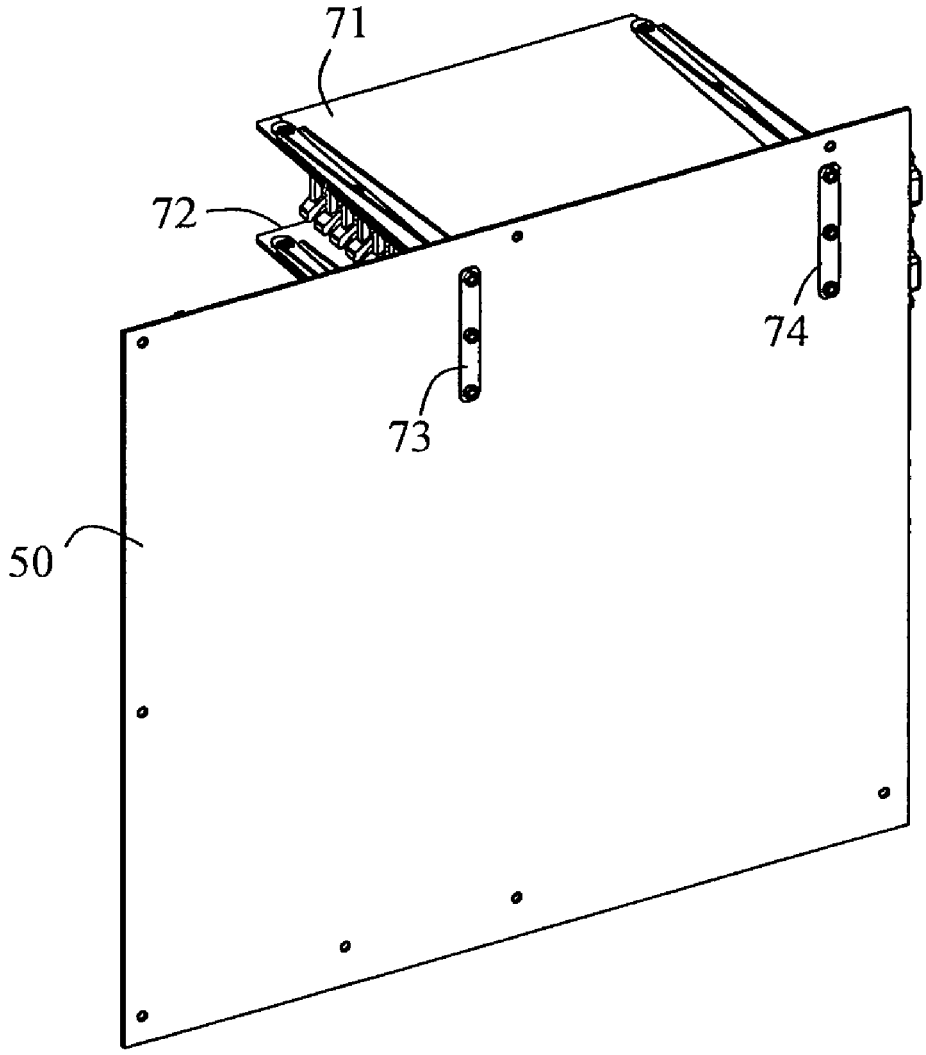

According to another aspect of the present invention, please refer to FIG. 6A. The riser cards 71, 72 could be respectively inserted into the two slots 21, 22 for interface card. The fixing manner is the same with what is described in the above and therefore is not repeated here. While the mounting manner of the fixing fragments 73, 74 is shown in FIG. 6B. The fixing fragments 73, 74 could be respectively fixed through the securing hole 4141 at the same sides of the two riser cards 71, 72 and then the fixing fragments 73, 74 connects the two riser cards 71, 72. Similarly, the riser card could be multiple ones that are fixed by the fixing fragments at the same sides, and the rest fixing manners are the same with what is described in the above. Similarly, enough supporting strength is efficiently provided within a limited space and the riser card is prevented from being bended and deformed when having memories mounted thereon.

Figure 5:
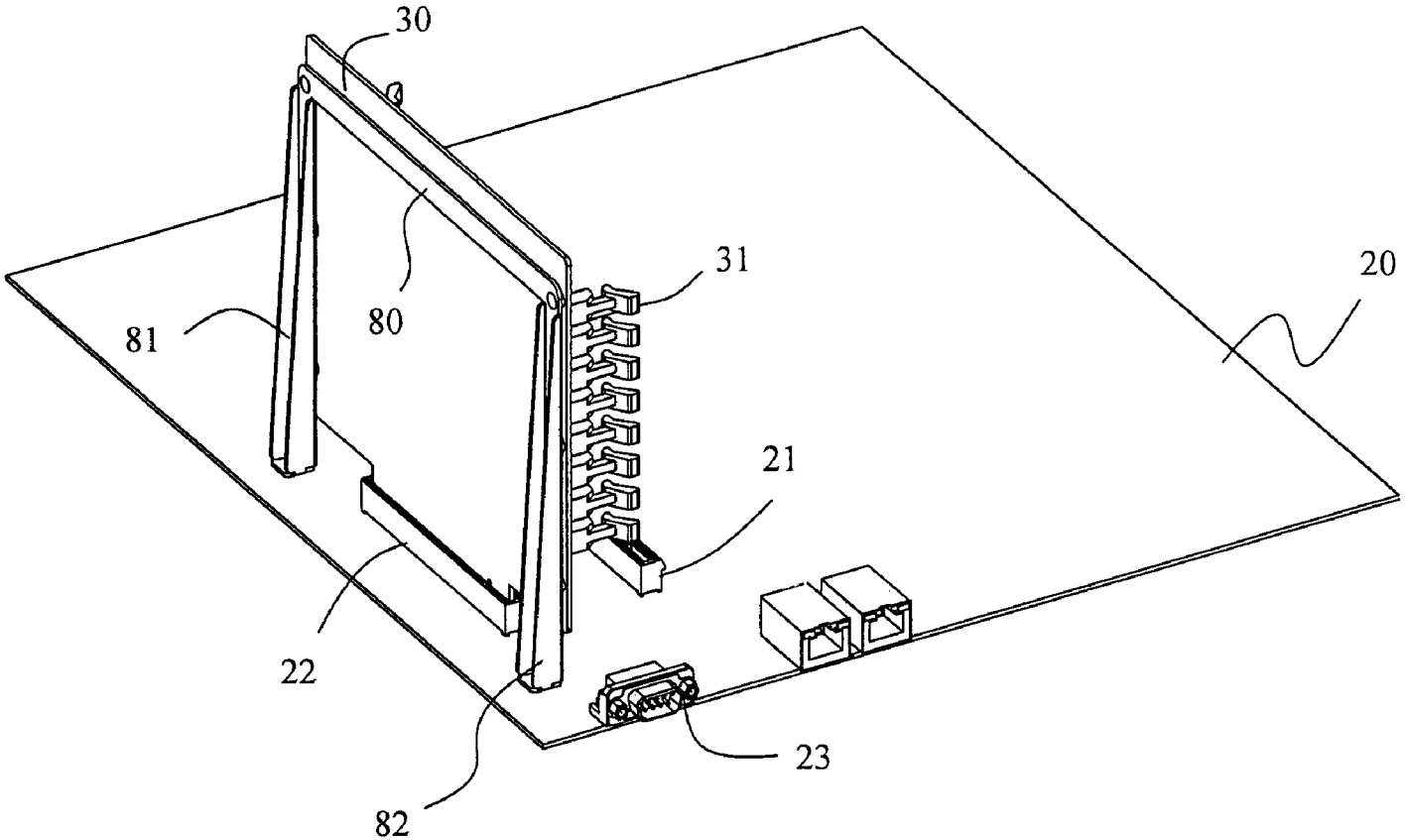
FIG. 5 is a schematic view showing a single riser card fixed onto the motherboard by the fixing module according to another preferred embodiment of the present invention.
Figure 7:
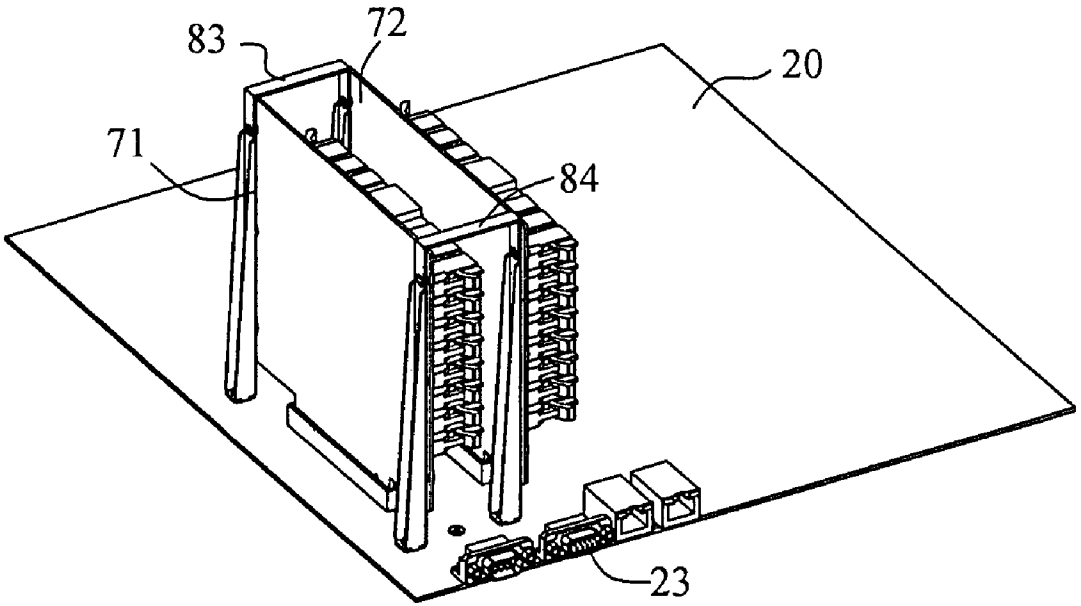
FIG. 7 is a schematic view showing two riser cards fixed onto the motherboard by the fixing module according to another preferred embodiment of the present invention.

Certainly, the supporting pillars of the two riser cards 71, 72 could have another varied structure, as shown in FIG. 5. Otherwise, as shown in FIG. 7, two fixing pillars 83, 84 are provided. Two supporting pillars are respectively formed and extended from two ends of each fixing pillar so as to fix the two riser cards 71, 72 at the same side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing module for a riser card, used for fixing the riser card onto a motherboard, comprising:

two supporting pillars respectively disposed at two sides of the riser card, wherein each supporting pillar comprises at least one fixing opening secured with the riser card, two opposite sides, and a bottom side having a securing hole thereon, and the bottom side and bottom parts of the two opposite sides are engaged with each other;

a fixing fragment disposed at the bottom side of the motherboard and having securing openings respectively disposed at two sides thereof and corresponding to the securing holes on the bottom sides of the two supporting pillars; and two fixing components respectively passing through the securing openings, the motherboard, and the securing holes on the bottom sides of the two supporting pillars so as to fix the two supporting pillars and the riser card onto the motherboard.

2. The fixing module of claim 1, wherein the two opposite sides of the supporting pillar have widths gradually wider towards the bottom parts thereof.

3. The fixing module of claim 1, wherein the fixing components are screws or rivets.

4. The fixing module of claim 1, wherein the fixing fragment further comprises an auxiliary opening for further fixing the fixing fragment onto the motherboard.

5. The fixing module of claim 1, wherein the bottom side and the bottom parts of the two opposite sides of the supporting pillar are engaged with each other scraggly.

6. The fixing module of claim 5, wherein the bottom parts of the two opposite sides have protruding shapes secured within two indenting sides of the bottom side.

7. The fixing module of claim 5, wherein the bottom side has a protruding shape secured within indenting sides of the bottom parts of the two opposite sides.

8. A computer system, comprising:

a motherboard comprising at least two slots for interface card, wherein the slot has two through holes respectively disposed at two sides thereof;

two riser cards inserted into the slots and mounted thereon;

four supporting pillars respectively disposed at two sides of the two riser cards, wherein each supporting pillar comprises at least one fixing opening secured with the riser card, two opposite sides, and a bottom side having a securing hole thereon, and the bottom side and bottom parts of the two opposite sides are engaged with each other;

two fixing fragments disposed at the bottom side of the motherboard and having securing openings respectively disposed at two sides thereof and corresponding to the securing holes on the bottom sides of the four supporting pillars, wherein each fixing fragment is mounted at the same sides of the two riser cards and connected to the two riser cards; and four fixing components respectively passing through the securing openings, the through holes of the motherboard, and the securing holes on the bottom sides of the two supporting pillars so as to fix the four supporting pillars and the riser card onto the motherboard.

9. The fixing module of claim 8, wherein the two opposite sides of the supporting pillar have widths gradually wider towards the bottom parts thereof.

10. The computer system of claim 8, wherein the fixing components are screws or rivets.

11. The computer system of claim 8, wherein the fixing fragment further comprises an auxiliary opening for further fixing the fixing fragment onto the motherboard.

12. The computer system of claim 8, wherein the bottom side and the bottom parts of the two opposite sides of the supporting pillar are engaged with each other scraggly.

13. The computer system of claim 12, wherein the bottom parts of the two opposite sides have protruding shapes secured within two indenting sides of the bottom side.

14. The computer system of claim 12, wherein the bottom side has a protruding shape secured within indenting sides of the bottom parts of the two opposite sides.

15. A fixing module for a riser card, used for fixing the riser card onto a motherboard, comprising:

a fixing pillar having a U-shape and two supporting pillars respectively formed at two ends thereof, wherein the supporting pillar is correspondingly disposed at two sides of the riser card and each supporting pillar comprises at least one fixing opening secured with the riser card, two opposite sides, and a bottom side having a securing hole thereon, and the bottom side and bottom parts of the two opposite sides are engaged with each other;

a fixing fragment disposed at the bottom side of the motherboard and having securing openings respectively disposed at two sides thereof and corresponding to the securing holes on the bottom sides of the two supporting pillars; and two fixing components respectively passing through the securing openings, the motherboard, and the securing holes on the bottom sides of the two supporting pillars so as to fix the two supporting pillars and the riser card onto the motherboard.

16. The fixing module of claim 15, wherein the two opposite sides of the supporting pillar have widths gradually wider towards the bottom parts thereof.

17. The fixing module of claim 15, wherein the fixing fragment further comprises an auxiliary opening for further fixing the fixing fragment onto the motherboard.

18. The fixing module of claim 15, wherein the bottom side and the bottom parts of the two opposite sides of the supporting pillar are engaged with each other scraggly.

19. The fixing module of claim 18, wherein the bottom parts of the two opposite sides have protruding shapes secured within two indenting sides of the bottom side.

20. The fixing module of claim 18, wherein the bottom side has a protruding shape secured within indenting sides of the bottom parts of the two opposite sides.

* * * * *